US006338671B1

(12) United States Patent
Kawashima et al.

(10) Patent No.: US 6,338,671 B1
(45) Date of Patent: Jan. 15, 2002

(54) APPARATUS FOR SUPPLYING POLISHING LIQUID

(75) Inventors: Kiyotaka Kawashima; Mitsunori Komatsu; Mutsumi Tanikawa; Fujihiko Toyomasu, all of Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/533,779

(22) Filed: Mar. 24, 2000

(30) Foreign Application Priority Data

Mar. 26, 1999 (JP) ..... 11-084785

(51) Int. Cl.[7] ..... B24G 9/00
(52) U.S. Cl. ..... 451/87; 451/99
(58) Field of Search ..... 451/5, 6, 36, 60, 451/87, 88, 91, 99, 100, 165, 910

(56) References Cited

U.S. PATENT DOCUMENTS 5,885,134 A * 3/1999 Shibata et al. ..... 451/41

FOREIGN PATENT DOCUMENTS

| | | |
|---|---|---|
| JP | 7-52045 | 2/1995 |
| JP | 7-100738 | 4/1995 |
| JP | 8-297108 | 11/1996 |
| JP | 10-315135 | * 12/1998 |
| JP | 11-138438 | 5/1999 |
| JP | 11-138439 | 5/1999 |
| WO | 96/02319 | 2/1996 |

* cited by examiner

*Primary Examiner*—Derris H. Banks
(74) *Attorney, Agent, or Firm*—Wenderoth, Lind & Ponack, L.L.P.

(57) ABSTRACT

An apparatus for supplying a polishing liquid to a polishing section is used for polishing a surface of a semiconductor substrate in the polishing section. The apparatus comprises a supply tank for storing a polishing liquid having given properties, a supply pipe for supplying the polishing liquid to the polishing section, a sensing device for detecting properties of the polishing liquid flowing through the supply pipe, and a stabilization device for maintaining properties of the polishing liquid stored in the supply tank or flowing through the supply pipe within an allowable range on the basis of an output signal from the sensing device.

27 Claims, 7 Drawing Sheets

APPARATUS FOR SUPPLYING POLISHING LIQUID

BACKGROUND OF THE INVENTION

1. Field of the Invention

The present invention relates to an apparatus for supplying a polishing liquid used for polishing a surface of a semiconductor substrate, and more particularly to an apparatus for supplying a polishing liquid containing uniformly dispersed abrasive particles therein to a polishing surface of a polishing unit in a stable condition.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus having a polishing unit (or section).

Conventionally, a polishing unit has a turntable and a top ring which rotate at respective individual speeds. A polishing cloth constituting a polishing surface is attached to the upper surface of the turntable. A semiconductor substrate to be polished is placed on the polishing cloth and clamped between the top ring and the turntable. An abrasive liquid containing abrasive particles is supplied onto the polishing cloth and retained on the polishing cloth. During operation, the top ring exerts a certain pressure on the turntable, and the surface of the semiconductor substrate held against the polishing cloth is therefore polished by a combination of chemical polishing and mechanical polishing to a flat mirror finish while the top ring and the turntable are rotated.

FIG. 7 is a schematic view showing the essential parts in an example of a polishing unit. The polishing unit comprises a turntable 142 having an upper surface to which a polishing cloth 140 is attached, a top ring 144 for holding a semiconductor wafer W as a polishing object and pressing the semiconductor wafer W against the polishing cloth 140 while rotating the semiconductor wafer W, and a polishing liquid supply nozzle 146 for supplying a polishing liquid Q to the polishing cloth 140. The polishing cloth 140 constitutes a polishing surface. The top ring 144 is coupled to a top ring shaft 148, and is vertically movably supported by an air cylinder (not shown).

The top ring 144 has an elastic pad 150 made of polyurethane or the like on its lower surface, and the semiconductor wafer W is held in such a manner that the semiconductor wafer W is closely brought in contact with the elastic pad 150. The top ring 144 is further provided with a cylindrical guide ring 152 on its outer periphery so that the semiconductor wafer W is not dislodged from the lower surface of the top ring 144. The guide ring 152 is fixed to the top ring 144, and the lower end of the guide ring 152 projects from the holding surface of the top ring 144 so that the semiconductor wafer W is retained in a recess defined by the holding surface of the top ring 144 and the guide ring 152.

In the polishing unit having the above structure, the semiconductor wafer W is held by the lower surface of the elastic pad 150 of the top ring 144, and pressed against the polishing cloth 140 on the turntable 142 by the top ring 144, and the turntable 142 and the top ring 144 are rotated so as to cause a relative sliding motion between the polishing cloth 140 and the semiconductor wafer W. At this time, a polishing liquid Q is supplied from the polishing liquid supply nozzle 146 to the polishing cloth 140. The polishing liquid comprises abrasive particles such as silica particles suspended in a chemical solution such as an alkali solution, and the semiconductor wafer W is polished by a combination of chemical polishing with alkali and mechanical polishing with the abrasive particles.

In order to perform a high quality polishing in the above polishing unit, it is necessary to supply a polishing liquid having a constant concentration at a constant flow rate to the polishing surface of the polishing unit. A polishing liquid supply system may comprise a storage tank for storing a condensate comprising a mixture of, for example, alkali such as KOH or $NH_4OH$ and silica particles, an adjusting tank for adjusting the condensate to a desired concentration by diluting the condensate with a liquid such as pure water or chemical solution, a supply tank for storing temporarily a polishing liquid adjusted in the adjusting tank, and a polishing liquid supply pipe for delivering the polishing liquid to a nozzle from the supply tank. The polishing liquid supply system further comprises pipes for connecting the tanks.

It is known that a polishing rate and a polishing quality in a polishing process depend on the concentration of the polishing liquid used for polishing semiconductor wafers. On the other hand, for reducing equipment cost and operating cost, a common polishing liquid supply source is required to be used for a plurality of polishing units. For this reason, the polishing liquid having a given concentration is temporarily stored in the adjusting tank or the supply tank, and is then delivered to the respective polishing units. As a result, the quality of the polishing liquid stored in the adjusting tank or the supply tank is degraded with an elapse of time, and hence the abrasive particles tend to aggregate for thereby making the effective size of particles larger. Thus, an undesirable polishing liquid containing excessively large abrasive particles may be delivered to the polishing units to cause a polished surface of the semiconductor substrate to be scratched or to decrease a polishing rate.

SUMMARY OF THE INVENTION

It is therefore an object of the present invention to provide an apparatus for supplying a polishing liquid which can continuously supply a polishing liquid having stable properties to a polishing section to perform a high quality polishing at all times.

In order to achieve the above object, according to a first aspect of the present invention, there is provided an apparatus for supplying a polishing liquid to a polishing section, comprising: a supply tank for storing a polishing liquid having given properties; a supply pipe for supplying the polishing liquid to the polishing section; a sensing device for detecting properties of the polishing liquid flowing through the supply pipe; and a stabilization device for maintaining properties of the polishing liquid stored in the supply tank or flowing through the supply pipe within an allowable range on the basis of an output signal from the sensing device.

According to the present invention, the properties of the polishing liquid supplied to the polishing section are continuously monitored, and when the polishing liquid has been degraded up to a condition that scratches are likely to be formed on a polished surface of the substrate by aggregated abrasive particles, various remedial procedures can be taken to stabilize the properties of the polishing liquid. Thus, the polishing liquid having stable properties is continuously supplied to the polishing section to provide a high quality polishing at all times. If it is found that the polishing liquid has been degraded to a large degree, then the operation of the polishing apparatus may be stopped to prevent inferior products from being produced.

In a preferred embodiment, the sensing device may measure at least one of particle size distribution, the number of coarse particles, oxidation-reduction potential, and solid material concentration in the polishing liquid.

According to the present invention, degradation of abrasive particles in the polishing liquid may be detected in real time directly or indirectly.

In a preferred embodiment, the stabilization device may uniformize particle size distribution.

The stabilization device for stabilizing the properties of polishing liquid may comprise an application device of ultrasonic energy to the polishing liquid, a filter for removing coarse particles, or an adding device of chemicals for adjusting the oxidation-reduction potential. The polishing liquid having a poor quality may be discarded, if necessary, to stabilize the properties of the polishing liquid.

In a preferred embodiment, the stabilization device comprises at least one of a filter for removing coarse particles, an ultrasonic generating device for breaking up coarse particles by ultrasonic energy, an adding device for supplying at least one of additives and abrasive particles to maintain a volume ratio of additives to abrasive particles in the polishing liquid at a constant value.

According to a second aspect of the present invention, there is provided a polishing apparatus for polishing a surface of a substrate, comprising: a turntable having a polishing surface; a top ring for holding a substrate and pressing the substrate against the polishing surface; and a polishing liquid supply unit for supplying a polishing liquid to the polishing surface, comprising: a supply tank for storing a polishing liquid having given properties; a supply pipe for supplying the polishing liquid to the polishing surface; a sensing device for detecting properties of the polishing liquid flowing through the supply pipe; and a stabilization device for maintaining properties of the polishing liquid stored in the supply tank or flowing through the supply pipe within an allowable range on the basis of an output signal from the sensing device.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Next, a polishing apparatus incorporating a polishing liquid supply apparatus (or unit) will be described below with reference to drawings.

Figure 1:
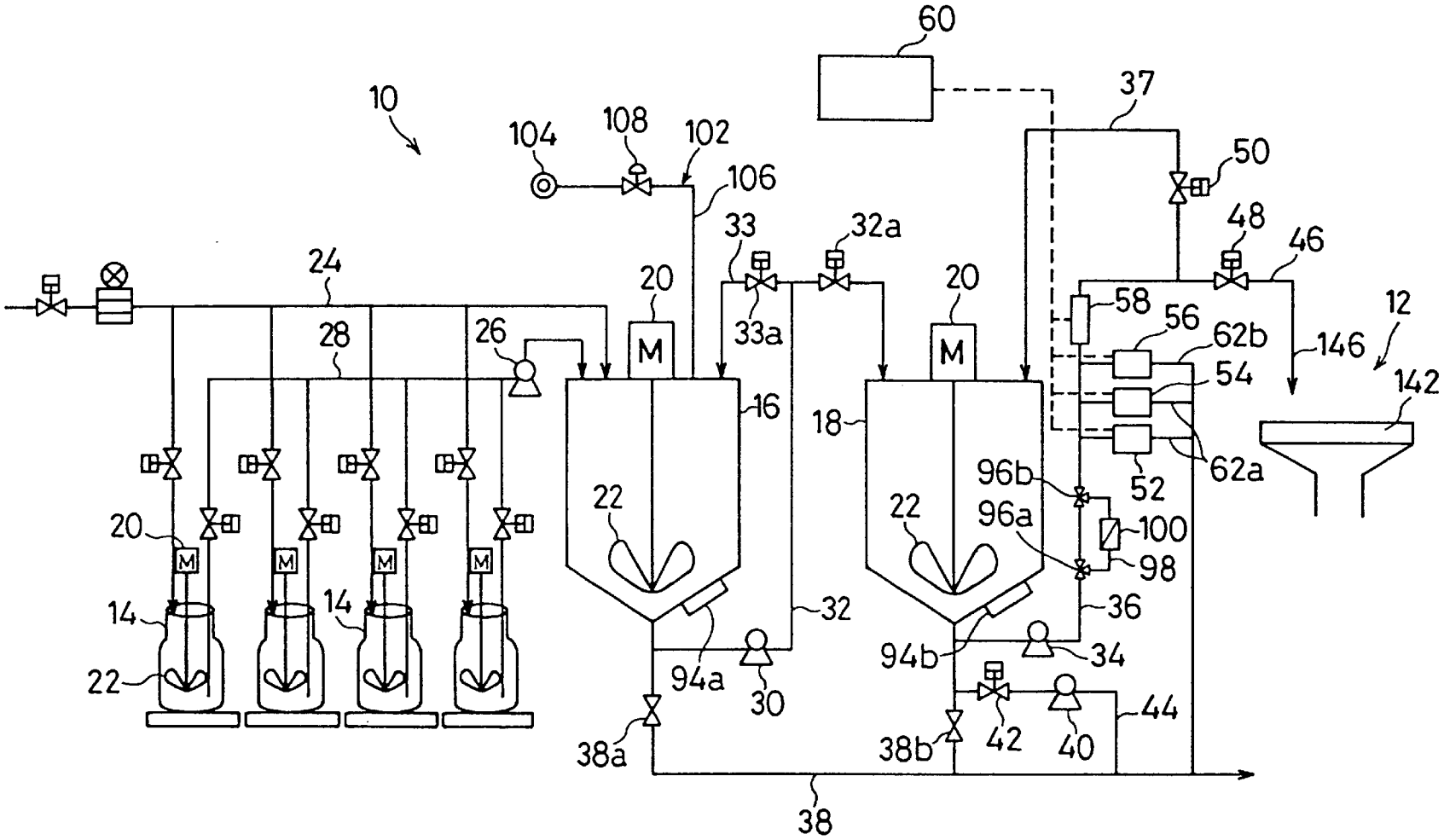
FIG. 1 is a schematic diagram of an overall polishing apparatus incorporating a polishing liquid supply apparatus according to a first embodiment of the present invention.
Figure 7:
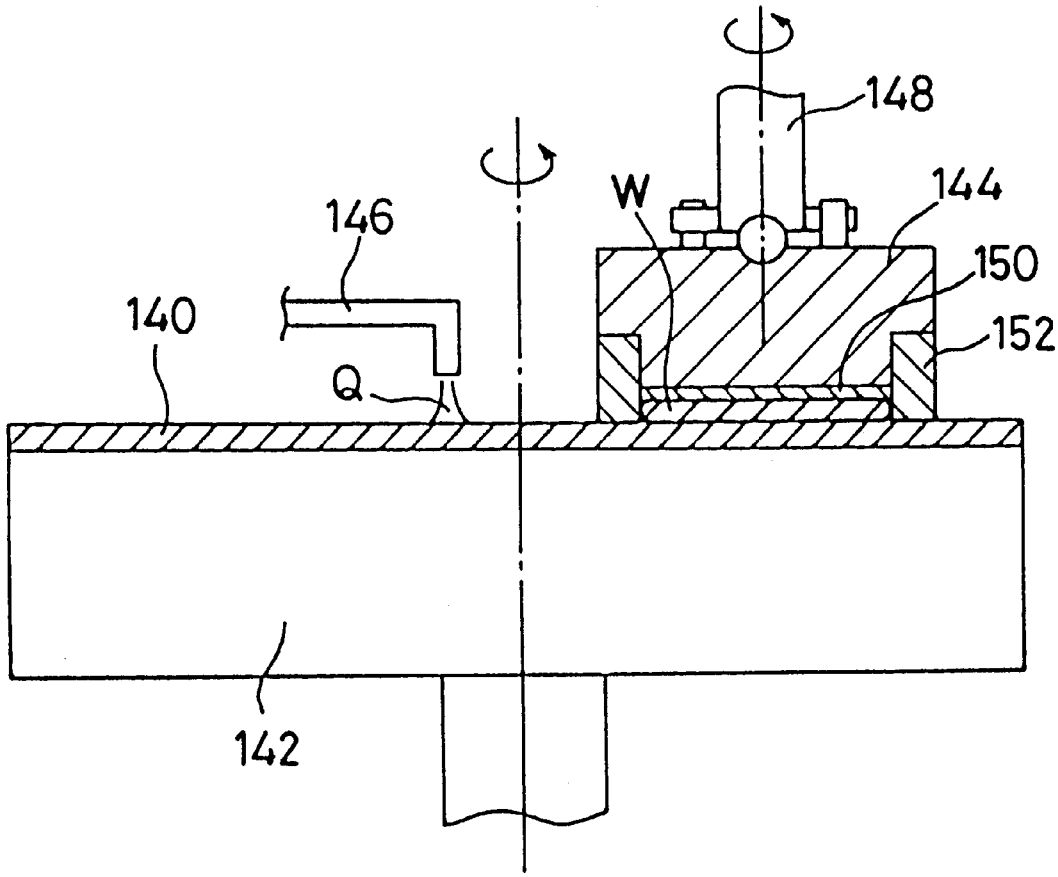
FIG. 7 is a schematic cross-sectional view of a conventional polishing unit.

As shown in FIG. 1, the polishing apparatus comprises a polishing liquid supply unit 10 and a polishing unit (or section) 12. The polishing unit 12 comprises a turntable 142 and a polishing liquid supply nozzle 146, but the polishing unit 12 may have the same structure as the conventional polishing unit shown in FIG. 7. The turntable 142 has a polishing surface on an upper surface thereof.

The polishing liquid supply unit 10 comprises a plurality of storage tanks 14 for storing a condensate, an adjusting tank 16 for adjusting a concentration of condensate by diluting the condensate with pure water or chemical solution, and a supply tank 18 for temporarily storing a polishing liquid adjusted in the adjusting tank 16 and supplying the polishing liquid to the polishing unit 12. A stirrer 22 having mixing blades is provided in each of the tanks 14, 16 and 18 to mix the liquid and particles by rotating the mixing blades with a motor 20. A pure water supply line 24 is connected to the storage tanks 14 and the adjusting tank 16, and the storage tanks 14 and the adjusting tank 16 are connected by a delivery pipe 28 having a pump 26.

The adjusting tank 16 is connected to the supply tank 18 by a delivery pipe 32 having a pump 30 and a shutoff valve 32*a*. The delivery pipe 32 has a return pipe 33 branched therefrom so that the polishing liquid is returned through a shutoff valve 33*a* to the adjusting tank 16. The supply tank 18 is connected to a polishing liquid supply pipe 46 for the polishing unit 12 through a supply pipe 36 having a supply pump 34. The supply pipe 36 has a return pipe 37 branched therefrom, and the return pipe 37 is connected to the supply tank 18 through a shutoff valve (circulation valve) 50.

The delivery pipe 32 and the supply pipe 36 are respectively branched in the upstream sides of the pumps 30 and 34, and the branched lines are connected to a discharge line 38 through respective shutoff valves 38*a* and 38*b*. The discharge line 38 extending from the supply pipe 36 has a branched discharge line 44 having a discharge pump 40 and a discharge valve 42. The supply pipe 36 has the polishing liquid supply pipe 46 for supplying the polishing liquid to the turntable 142 in the polishing unit 12. The polishing liquid supply pipe 46 has a supply valve 48, and the return pipe 37 branched from the supply pipe 36 has the shutoff valve 50 in the downstream side of the branch point of the polishing liquid supply pipe 46 branched from the supply pipe 36.

The supply pipe 36 has sampling pipes 62*a*, 62*a* and 62*b* branched therefrom in the downstream side of the pump 34 and the upstream side of the branch point of the return pipe 37 branched from the polishing liquid supply pipe 46, and the sampling pipes 62*a*, 62*a* and 62*b* have a particle size distribution measuring device 52, a coarse particle measuring device 54 and an oxidation-reduction electrometer 56, respectively. These pipes 62*a*, 62*a* and 62*b* are merged together in the downstream side of the measuring devices 52, 54 and 56 into a discharge pipe which is then connected to the discharge line 38. The supply pipe 36 has a solid material concentration measuring device 58 in the downstream side of the branch points of the sampling pipes 62*a*, 62*a* and 62*b*. The measurements of the respective devices 52, 54, 56 and 58 are inputted into a controller 60. In this embodiment, each of the particle size distribution measuring device 52, the coarse particle measuring device 54, the oxidation-reduction electrometer 56, and the solid material concentration measuring device 58 constitutes a sensing device. The particle size distribution measuring device 52 and the coarse particle measuring device 54 may use devices sold by Particle Sizing Systems. The coarse particle measuring device 54 may use a device sold under the trade name of Accusizer 780 OL.

Figure 2:
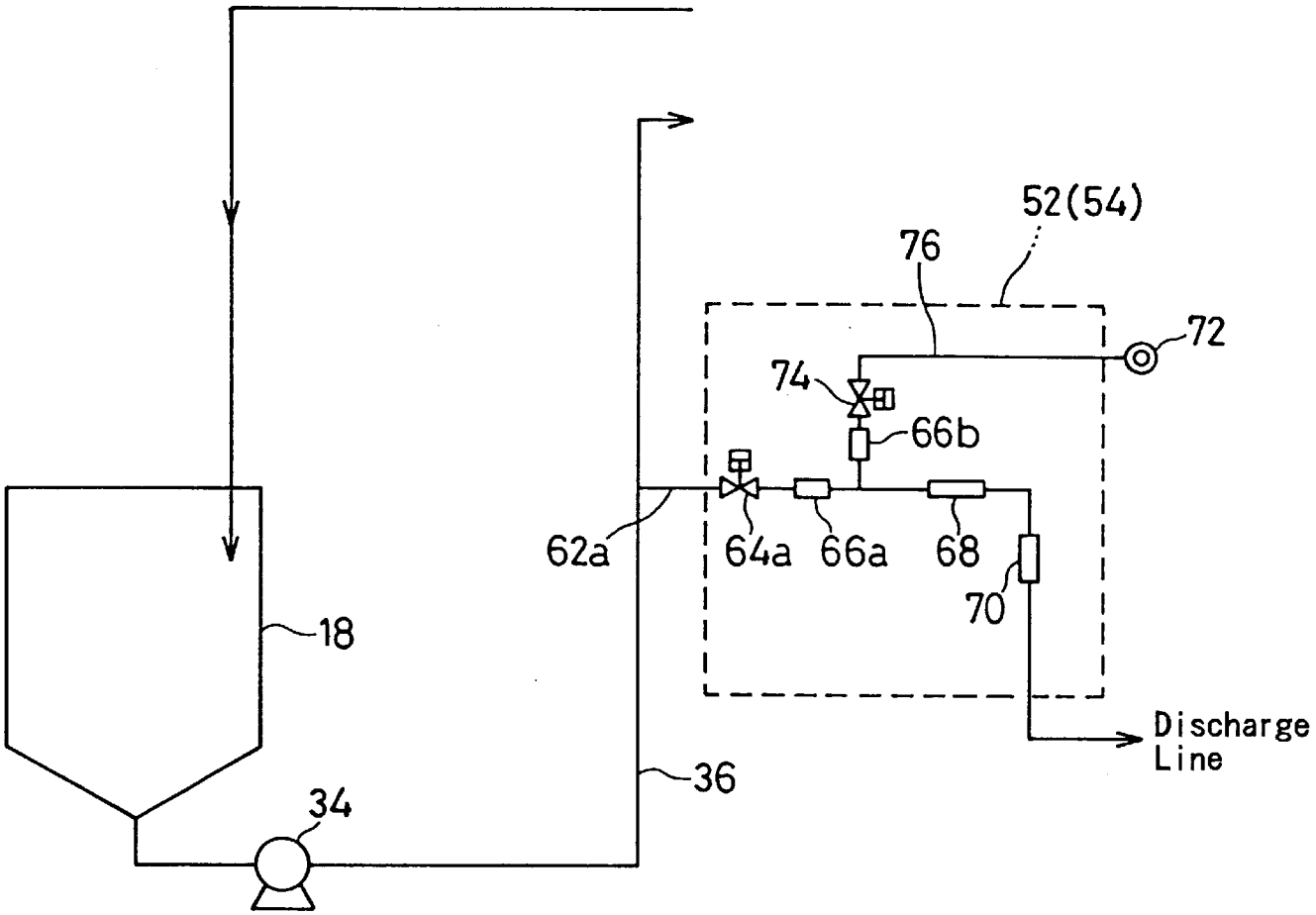
FIG. 2 is a schematic diagram of a particle size distribution measuring device and a coarse particle size measuring device.

As shown in FIG. 2, the particle size distribution measuring device 52 and the coarse particle measuring device 54 are connected to the supply pipe 36 through the sampling pipes 62*a*, respectively. Each of the sampling pipes 62*a* has a sampling valve 64*a*, a flow rate regulator 66*a*, a line-mixer 68, and a particle size sensor 70 in sequence. A diluting liquid pipe 76 extending from a diluting liquid supply source 72 is connected to the sampling pipe 62*a* through a diluting valve 74 and a flow rate regulator 66*b* at a location between the flow rate regulator 66*a* and the line-mixer 68.

Accordingly, a portion of the polishing liquid flowing through the supply pipe 36 flows into the sampling pipe 62*a* at a controlled flow rate through the flow rate regulator 66*a*, and the polishing liquid is mixed in the line-mixer 68 with the diluting liquid flowing through the flow rate regulator 66*b* by which a flow rate of the diluting liquid is controlled. Thus, after the polishing liquid having a given concentration is produced, it is supplied to the particle size sensor 70 as a sample liquid to be checked. The particle size sensor 70 measures the particle size distribution or the number of coarse particles in the sample liquid. The particle size distribution measuring device 52 and the coarse particle measuring device 54 have the respective particle size sensors 70 by which the particle size ranges to be measured are different from each other, but the sensors 70 have the same structure. By measuring the particle sizes different from each other, individually, the accuracy of measurement is improved.

In the polishing liquid supply system shown in FIG. 1, by using a bellows pump as the supply pump 34, and a slurry of commercially available colloidal silica as a polishing liquid, the particle size distribution in the polishing liquid was measured by the particle size distribution measuring device 52, and the number of coarse particles in the polishing liquid was measured by the coarse particle measuring device 54. It was confirmed that the center of particle size distribution in the polishing liquid shifted towards the larger particle size side with an elapse of time after producing the polishing liquid.

Figure 3:
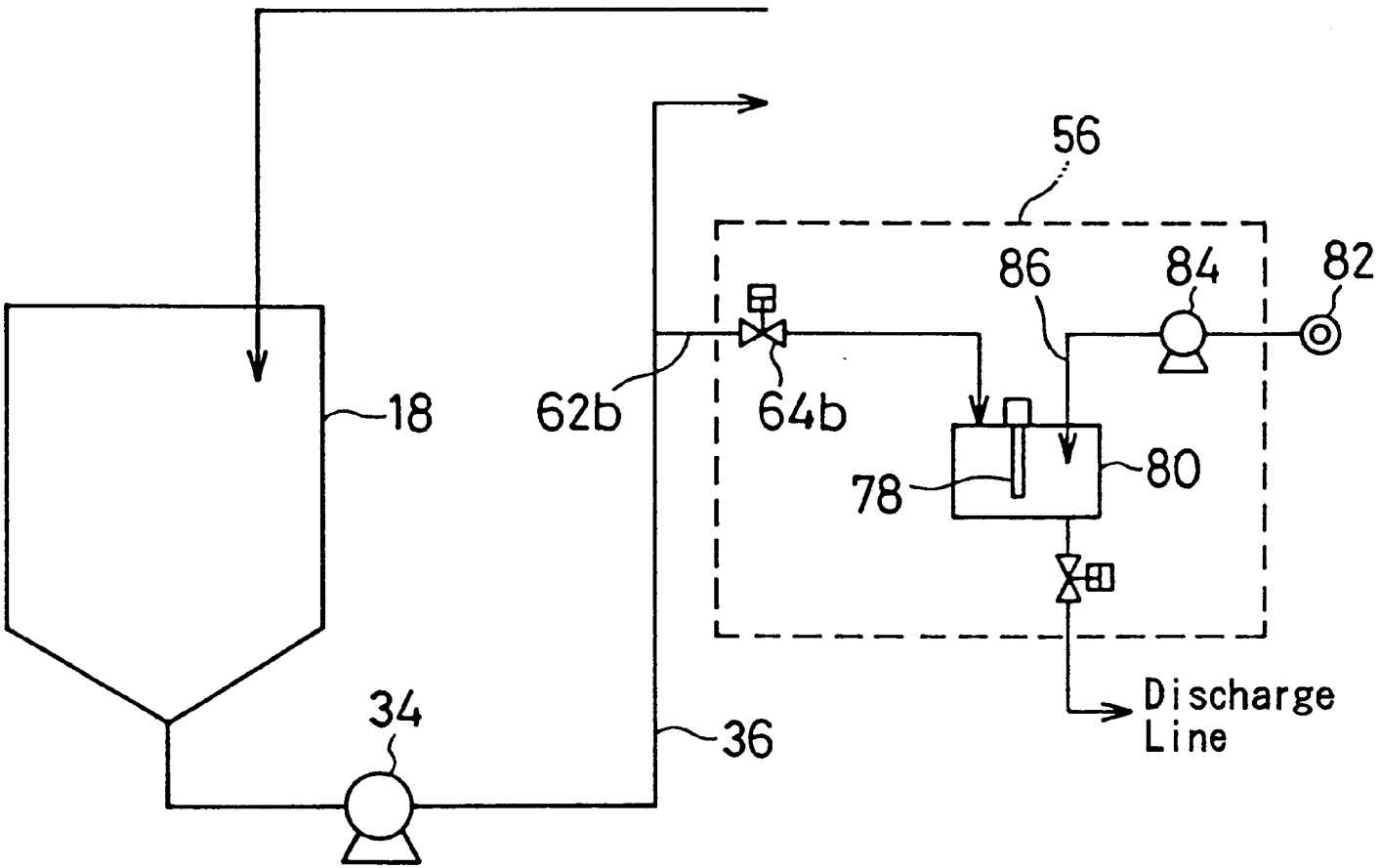
FIG. 3 is a schematic diagram of an oxidation-reduction electrometer.

As shown in FIG. 3, the oxidation-reduction electrometer 56 has the sampling pipe 62*b* connected to the supply pipe 36. In the sampling pipe 62*b*, there are provided a sampling valve 64*b* and a measuring vessel 80 having a sensor electrode 78 in sequence, and the measuring vessel 80 is connected to the discharge line 38. A chemical supply source 82 is connected to the measuring vessel 80 through a chemical delivery pipe 86 having a metering pump 84. In this arrangement, a small amount of chemicals such as hydrogen peroxide or potassium permanganate is added to the polishing liquid introduced into the measuring vessel 80, and oxidation-reduction potential of the liquid may be measured by the electrode 78.

Figure 4:
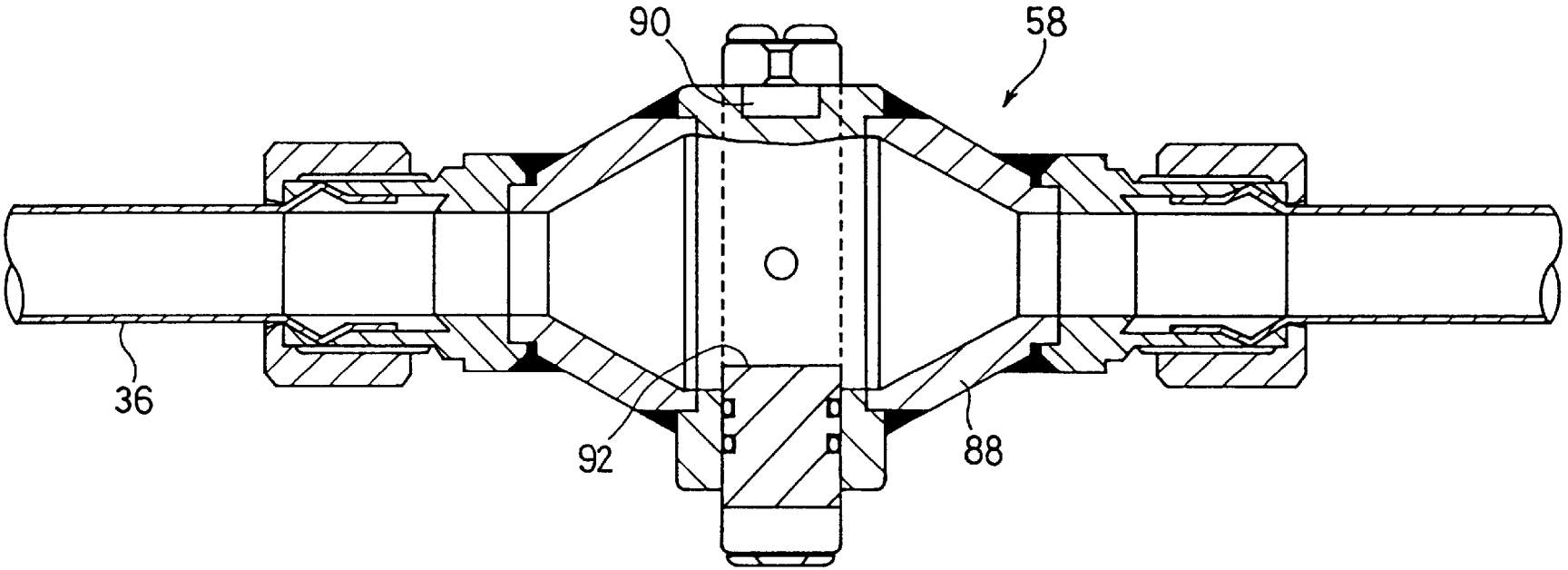
FIG. 4 is a cross-sectional view of a solid material concentration measuring device.

In this example, the solid material concentration measuring device 58 utilizes ultrasonic waves, and comprises an ultrasonic transducer 90 and a reflection surface 92 housed in a casing 88 connected to the supply pipe 36 as shown in FIG. 4. The ultrasonic transducer 90 and the reflection surface 92 are confronted with each other and disposed at a right angle to the flow direction of the polishing liquid. In this arrangement, ultrasonic waves are applied from the ultrasonic transducer 90 to the reflection surface 92, and the propagation velocity of ultrasonic waves in the polishing liquid is measured, thereby measuring concentration of the polishing liquid. A temperature sensor is provided in the casing to correct any effect caused by temperature variations.

Next, the results measured by the solid material concentration measuring device 58 will be described.

Figure 5:
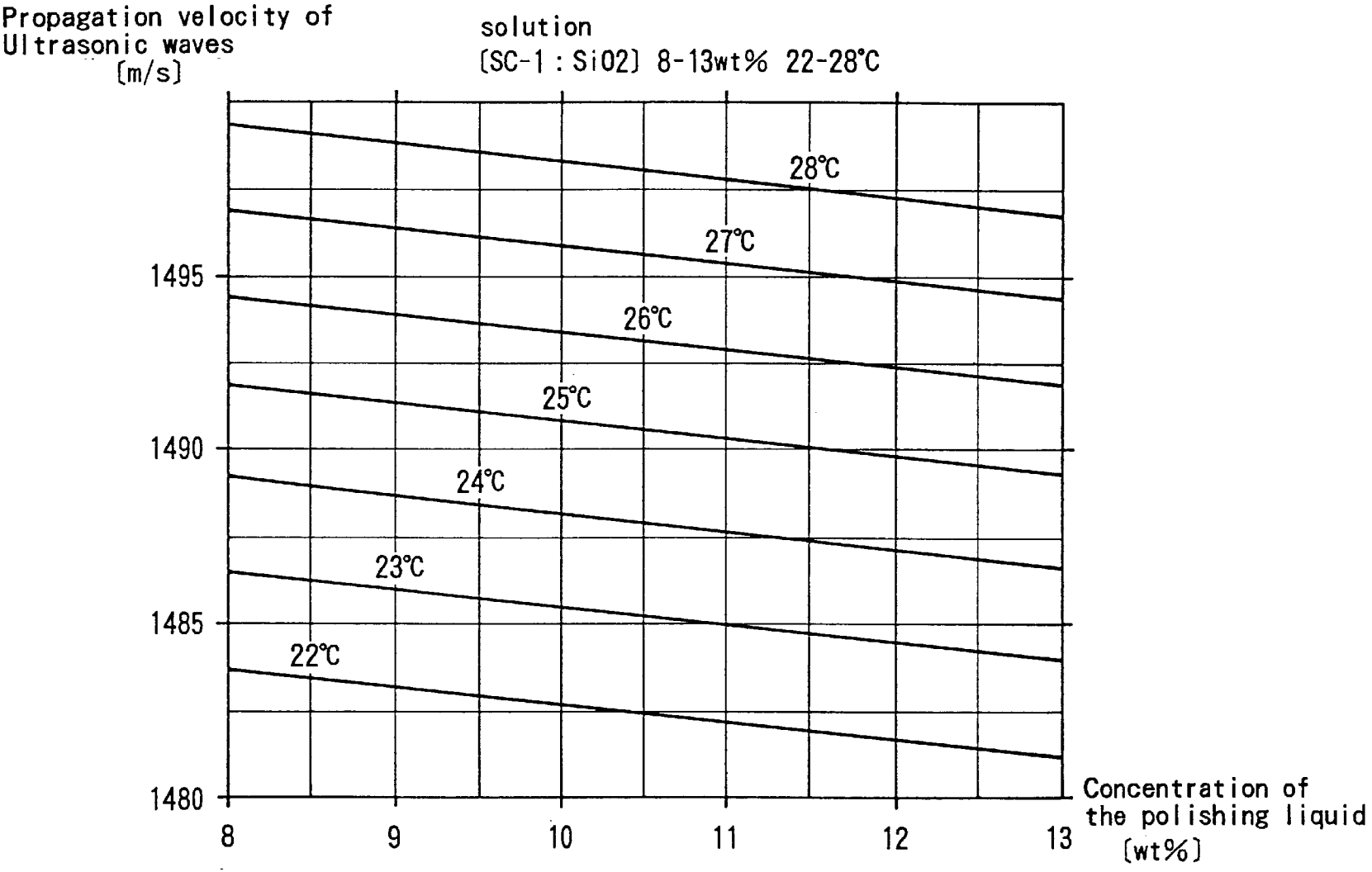
FIG. 5 is a graph showing the relationship between the propagation velocity of ultrasonic waves and concentration of a polishing liquid at various temperatures of the polishing liquid.

FIG. 5 shows an example of the results measured by the device 58 on a polishing liquid containing colloidal silica particles. As shown in FIG. 5, the propagation velocity of ultrasonic waves differs depending on the concentration of the polishing liquid in each of temperatures of the polishing liquid, i.e., there is a certain correlation between the propagation velocity of ultrasonic waves and the concentration of the polishing liquid. Therefore, when the temperature of the polishing liquid and the propagation velocity of ultrasonic waves are known, the concentration of the polishing liquid can be measured.

As shown in FIG. 1, ultrasonic transducers 94*a*, 94*b* are provided on the bottoms of the adjusting tank 16 and the supply tank 18 in the polishing liquid supply unit 10 as a first stabilization device for stabilizing the properties of the polishing liquid. These ultrasonic transducers 94*a*, 94*b* allow the aggregated particles distributed over a wide range of particle sizes to be broken up by the energy of ultrasonic vibration.

As a result, the sizes of abrasive particles contained in the polishing liquid in the adjusting tank 16 and the supply tank 18 are uniformized.

In the downstream side of the supply pump 34 in the supply pipe 36, a bypass line 98 capable of changing the flow direction of the polishing liquid by three-way valves 96*a*, 96*b* is disposed parallel to the supply pipe 36, and the bypass line 98 is provided with a filter 100 as a second stabilization device for the polishing liquid. The filter 100 serves to remove coarse particles contained in the polishing liquid.

The adjustment tank 16 has a chemicals adding device 102 as a third stabilization device for the polishing liquid. The chemicals adding device 102 comprises a chemicals supply source 104, and a chemicals supply line 106 connected to the adjusting tank 16 through a flow rate control valve 108. By the chemicals adding device 102, the volume ratio of the additives and abrasive particles contained in the polishing liquid in the adjusting tank 16 can be maintained at a constant value and the distribution of the particle sizes in the polishing liquid can be uniformized by adding acidic additives such as $H_2O_2$ or nitric acid, or alkali additives such as KOH or $NH_4OH$, or neutral chemicals such as surfactant to the polishing liquid in the adjusting tank 16.

The operation of these stabilization devices is controlled by signals from the controller 60. That is, the ultrasonic transducers 94*a*, 94*b*, the three-way valves 96*a*, 96*b*, and the flow rate control valve 108 of the chemicals adding device 102 are controlled by signals from the controller 60 on the basis of measurements obtained by the measuring devices 52, 54, 56 and 58.

Next, the operation of the polishing apparatus having the above structure will be described below. The condensate stored in the storage tanks 14 is supplied to the adjusting tank 16 by operating the pump 26, and is diluted to a certain concentration with pure water supplied from the pure water supply line 24. After being adjusted to a desired concentration, the polishing liquid is fed to the supply tank 18 by operating the delivery pump 30, and is stored therein.

The polishing liquid stored in the supply tank 18 flows through the supply pipe 36 by operating the supply pump 34, and while polishing of the semiconductor wafer is conducted, the polishing liquid is supplied through the polishing liquid supply pipe 46 and the polishing liquid supply nozzle 146 to the polishing surface of the turntable 142 in the polishing unit 12 by opening the supply valve 48. After polishing of the semiconductor wafer is completed, the supply valve 48 is closed, and the circulation valve 50 is opened to circulate the polishing liquid through the circulation path comprising the supply tank 18, the supply pipe 36 and the return pipe 37. Thus, even when the polishing liquid is not being supplied to the polishing unit, the polishing liquid is prevented from being stagnated in the pipes and the abrasive particles in the polishing liquid are prevented from being deposited in the pipes.

At this time, the polishing liquid flowing through the supply pipe 36 is monitored by the particle size distribution measuring device 52, the coarse particle measuring device 54, the oxidation-reduction electrometer 56, and the solid material concentration measuring device 58 to determine particle size distribution, the number of coarse particles, oxidation-reduction potential, and the solid material concentration, and the measurements are inputted into the controller 60 for continuing monitoring.

The controller 60 judges whether there has been any change in the particle size distribution, and any coarse particles have been produced on the basis of the inputted measurements. When it is judged that a change has taken place in the particle size distribution, one or both of the ultrasonic transducers 94*a*, 94*b*are operated to disperse the particles in the polishing liquid stored in one or both of the adjusting tank 16 and the supply tank 18 by the application of ultrasonic energy. When it is judged that there has been an increase in the concentration of coarse particles, the three-way valves 96*a*, 96*b* are switched to allow the polishing liquid to pass through the bypass line 98, thereby removing the coarse particles in the polishing liquid by the filter 100. Further, when it is judged that there has been a change in either the oxidation-reduction potential or the solid material concentration, the flow rate control valve 108 of the chemicals adding device 102 is opened, and by adding chemicals to the polishing liquid in the adjusting tank 16, the oxidation-reduction potential or the solid material concentration of the polishing liquid is adjusted to keep the volume ratio of additives to abrasive particles at a constant value and to uniformize the particle size distribution in the polishing liquid.

When measurements of the polishing liquid flowing through the supply pipe 36 exceed predetermined limits set in the respective devices, it is judged that the polishing liquid has been degraded. Then, the discharge valve 42 is opened and the discharge pump 40 is operated to cause the polishing liquid in the supply tank 18 to be discharged through the discharge line 38, and a new polishing liquid is prepared in the adjusting tank 16. The polishing liquid supply unit 10 and the polishing unit 12 communicate with each other by communication lines so that the polishing unit 12 is controlled so as not to commence a new polishing operation, if the above undesirable state occurs.

A newly prepared polishing liquid is supplied to the supply tank 18 from which it is circulated within the supply pipe 36, and the properties of the polishing liquid are monitored by the respective measuring devices. After it is confirmed that the measurements do not exceed the predetermined limits by the controller 60, an instruction to commence a polishing operation is sent from the controller 60 to the polishing unit 12. The polishing unit 12 resumes a polishing operation after the operator confirms that the abnormal condition has been removed. It is, of course, permissible to resume a polishing operation after the controller confirms given operating conditions so that the abnormal condition is automatically removed.

In the polishing apparatus, the limits predetermined in the respective measuring devices are different from one another depending on the kind of a polishing liquid.

Typical limits are as follows: for a colloidal silica type polishing liquid, the particles having a diameter of 1 $\mu$m or larger should be contained by less than 0.1% of the total amount of the polishing liquid; the number of coarse particles should be such that the particles equal to or larger than 5 $\mu$m is equal to or less than 100 particles/ml; the oxidation-reduction potential should be equal to or less than 1.0% of the initial value; and the solid material concentration should be equal to or less than ±5% of the setting.

In the above embodiment, although the measuring devices are positioned on or near the supply pipe 36, they may be positioned at any places including the delivery pipe 32, the adjusting tank 16 and the supply tank 18, as long as the polishing liquid can contact the measuring devices. Especially, it is preferable that the oxidation-reduction electrometer 56 and the solid material concentration measuring device 58 are provided in the adjusting tank 16 or the delivery pipe 32.

Further, as measuring devices for measuring degradation of the polishing liquid, a pH measuring device, a $\zeta$ potential measuring device, a turbidity measuring device, and a viscosity measuring device are included, and they may be provided in the polishing liquid supply system. Further, a chemicals concentration measuring device utilizing near infrared radiation may be employed to measure chemical components added to the polishing liquid.

Figure 6:
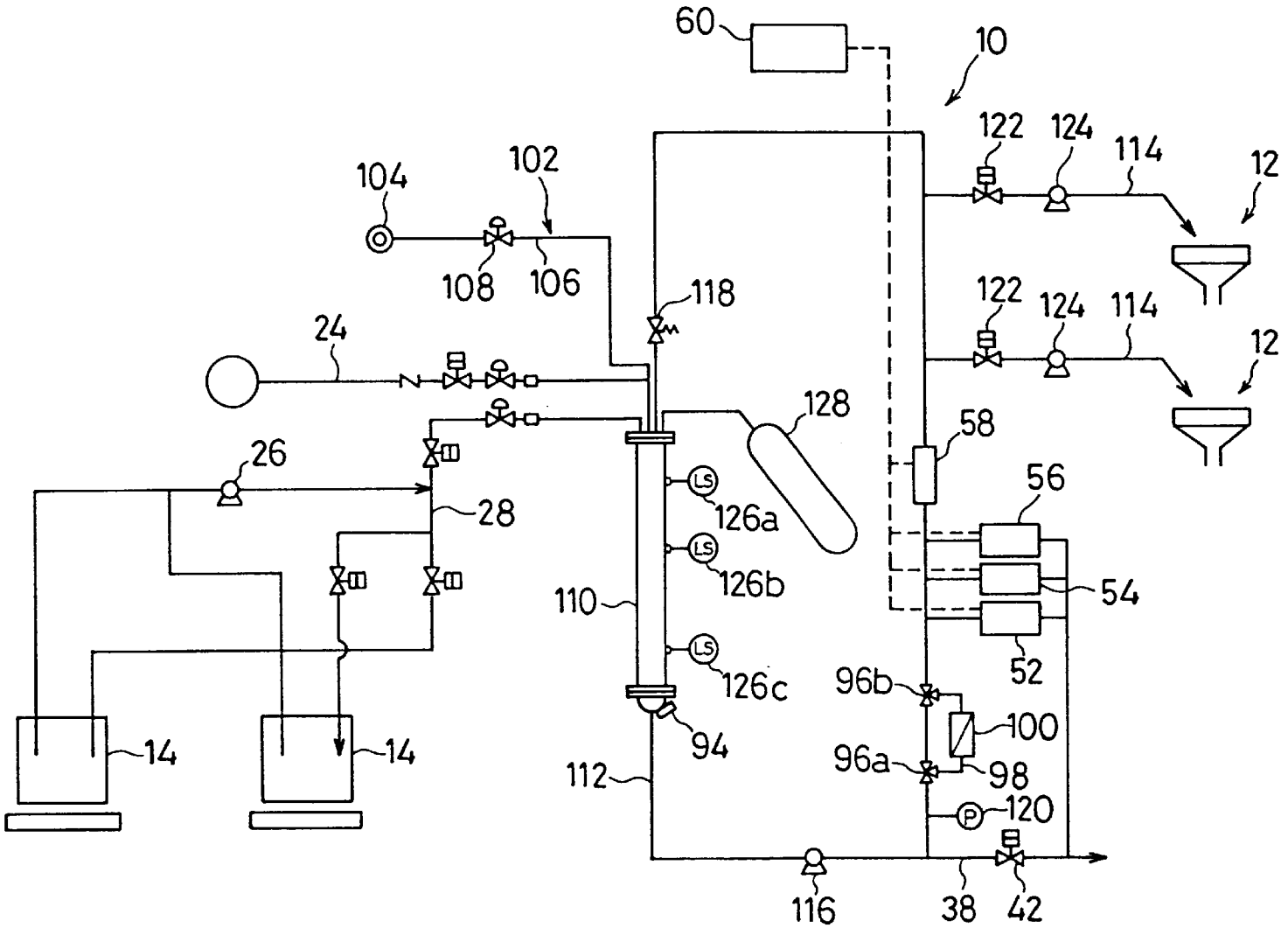
FIG. 6 is a schematic diagram of an overall polishing apparatus incorporating a polishing liquid supply apparatus according to a second embodiment of the present invention.

FIG. 6 is a schematic diagram of an overall polishing apparatus incorporating a polishing liquid supply apparatus according to a second embodiment of the present invention. As shown in FIG. 6, a common supply tank is used to supply a polishing liquid to a plurality of polishing units. In FIG. 6, although two polishing units 12 are illustrated, three or more polishing units connected to the common supply tank may be provided. The polishing liquid supply unit 10 comprises a cylindrical buffer tube 110 serving as a container, a circulation pipe 112 extending from a bottom of the buffer tube 110, passing through the locations near the polishing units 12, and returning to the top end of the buffer tube 110, and polishing liquid supply pipes 114 branched from the circulation pipe 112 and extending to the respective polishing units 12 to deliver the polishing liquid to the respective polishing units 12.

The circulation pipe 112 has a circulation pump 116 for constantly circulating a given flow rate of the polishing liquid, and a back pressure regulating valve 118 and a pressure sensor 120 for maintaining the internal pressure of the pipe at a constant value or higher. Each of the polishing liquid supply pipes 114 has a polishing liquid supply valve 122 and a pump 124 for withdrawing the polishing liquid individually from the circulation pipe 112.

The buffer tube 110 serves both as the adjusting tank 16 and the supply tank 18 in the first embodiment, and has a top end to which a delivery pipe 28, a pure water supply line 24, and a chemicals supply line 106 are connected. The buffer tube 110 has a first stabilization device comprising an ultrasonic transducer 94, liquid level sensors 126*a*, 126*b*, 126*c* for detecting liquid levels, and an airbag 128 made of an extendable material. The airbag 128 serves to suppress fluctuations in the internal pressure caused by the changes in the liquid level of the buffer tube 110 while a space in the buffer tube 110 is hermetically sealed.

In this embodiment, the particle size distribution measuring device 52, the coarse particle measuring device 54, the oxidation-reduction electrometer 56, and the solid material concentration measuring device 58 are provided at certain positions of the circulation pipe 112, i.e., in the downstream side of the circulation pump 116. A bypass line 98 branched from the circulation pipe 112 and having a filter 100 is provided in parallel to the circulation pipe 112. A discharge line 38 is provided to remove the degraded polishing liquid from the buffer tube 110.

The method of operating the polishing apparatus in this embodiment is basically the same as that in the first embodiment, and hence the explanation thereof will not be made. According to the polishing liquid supply unit of this embodiment, change of the concentration of polishing liquid caused by stagnation of the polishing liquid in the pipe can be prevented and clogging of the pipe caused by deposition of solid material can be prevented by constantly circulating the polishing liquid to be supplied to the portions near the polishing units 12. As a result, since the overall length of the piping system can be lengthened, the polishing liquid can be stably supplied to many polishing units 12 from one buffer tube 110 serving as a supply source, and therefore the apparatus cost can be lowered. It may be possible to provide measuring devices for measuring the properties of the polishing liquid in each of the polishing liquid supply pipes 114.

As described above, according to the present invention, the change of the properties of the polishing liquid is measured, and the properties of the polishing liquid is improved on the basis of the measurements. Therefore, since the effective size of particles does not become large, a polished surface of a semiconductor substrate is prevented from being damaged and a polishing rate of the semiconductor substrate is prevented from being decreased. Thus, in the polishing apparatus, semiconductor substrates can be stably and continuously polished in a good polishing condition.

Although certain preferred embodiments of the present invention have been shown and described in detail, it should be understood that various changes and modifications may be made therein without departing from the scope of the appended claims.

What is claimed is:

1. An apparatus for supplying a polishing liquid to a polishing section, comprising:

a supply tank for containing a polishing liquid;

a supply pipe for supplying the polishing liquid to the polishing section;

a sensing device for detecting properties of the polishing liquid flowing through said supply pipe; and a stabilization device for maintaining properties of the polishing liquid contained in said supply tank or flowing through said supply pipe within an allowable range on the basis of an output signal from said sensing device;

wherein said sensing device is to measure at least one of particle size distribution in the polishing liquid, the number of coarse particles in the polishing liquid, oxidation-reduction potential of the polishing liquid, and solid material concentration of the polishing liquid by measuring the propagation velocity of ultrasonic waves in the polishing liquid.

2. The apparatus according to claim 1, wherein said stabilization device is to uniformize the particle size distribution in the polishing liquid.

3. The apparatus according to claim 1, wherein said stabilization device comprises at least one of a filter for removing coarse particles from the polishing liquid, an ultrasonic generating device for breaking up coarse particles in the polishing liquid by applying ultrasonic energy to the coarse particles, and an adding device for supplying at least one of additives and abrasive particles to the polishing liquid to maintain a volume ratio of additives to abrasive particles in the polishing liquid at a constant value.

4. The apparatus according to claim 1, wherein said stabilization device comprises a member for removing coarse particles from the polishing liquid.

5. The apparatus according to claim 4, wherein said member comprises a filter.

6. The apparatus according to claim 4, wherein said member is to remove from the polishing liquid coarse particles having a diameter of at least 5 $\mu$m.

7. An apparatus for supplying a polishing liquid to a polishing section, comprising:

a supply tank for containing a polishing liquid;

a supply pipe for supplying the polishing liquid to the polishing section;

a sensing device for detecting properties of the polishing liquid flowing through said supply pipe; and a stabilization device for maintaining properties of the polishing liquid contained in said supply tank or flowing through said supply pipe within an allowable range on the basis of an output signal from said sensing device;

wherein said stabilization device is to uniformize the particle size distribution in the polishing liquid.

8. The apparatus according to claim 7, wherein said sensing device is to measure at least one of particle size distribution in the polishing liquid, the number of coarse particles in the polishing liquid, oxidation-reduction potential of the polishing liquid, and solid material concentration of the polishing liquid.

9. The apparatus according to claim 7, wherein said stabilization device comprises at least one of a filter for removing coarse particles from the polishing liquid and an ultrasonic generating device for breaking up coarse particles in the polishing liquid by applying ultrasonic energy to the coarse particles.

10. The apparatus according to claim 7, wherein said stabilization device comprises a member for removing coarse particles from the polishing liquid.

11. The apparatus according to claim 10, wherein said member comprises a filter.

12. The apparatus according to claim 10, wherein said member is to remove from the polishing liquid coarse particles having a diameter of at least 5 $\mu$m.

13. A polishing apparatus for polishing a surface of a substrate, comprising:

a turntable having a polishing surface;

a top ring for holding a substrate and pressing the substrate against said polishing surface; and a polishing liquid supply unit for supplying a polishing liquid to said polishing surface, wherein said polishing liquid supply unit comprises:

a supply tank for containing a polishing liquid;

a supply pipe for supplying the polishing liquid to said polishing surface;

a sensing device for detecting properties of the polishing liquid flowing through said supply pipe; and a stabilization device for maintaining properties of the polishing liquid contained in said supply tank or flowing through said supply pipe within an allowable range on the basis of an output signal from said sensing device;

wherein said sensing device is to measure at least one of particle size distribution in the polishing liquid, the number of coarse particles in the polishing liquid, oxidation-reduction potential of the polishing liquid, and solid material concentration of the polishing liquid by measuring the propagation velocity of ultrasonic waves in the polishing liquid.

14. The apparatus according to claim 13, wherein said stabilization device is to uniformize the particle size distribution in the polishing liquid.

15. The apparatus according to claim 13, wherein said stabilization device comprises at least one of a filter for removing coarse particles from the polishing liquid, an ultrasonic generating device for breaking up coarse particles in the polishing liquid by applying ultrasonic energy to the coarse particles, and an adding device for supplying at least one of additives and abrasive particles to the polishing liquid to maintain a volume ratio of additives to abrasive particles in the polishing liquid at a constant value.

16. The apparatus according to claim 13, further comprising a controller for controlling said polishing apparatus so as not to commence a new polishing operation when measurements of the polishing liquid exceed predetermined limits.

17. A polishing apparatus comprising:

a plurality of polishing units for polishing a substrate;

a polishing liquid circulation line for circulating a polishing liquid therein and supplying the polishing liquid to said polishing units; and a sensing device for detecting properties of the polishing liquid flowing through said polishing liquid circulation line, wherein said sensing device is to measure at least one of particle size distribution in the polishing liquid, the number of coarse particles in the polishing liquid, oxidation-reduction potential of the polishing liquid, and solid material concentration of the polishing liquid by measuring the propagation velocity of ultrasonic waves in the polishing liquid.

18. The apparatus according to claim 17, further comprising a stabilization device for maintaining properties of the polishing liquid flowing through said polishing liquid circulation line within an allowable range on the basis of an output signal from said sensing device.

19. The apparatus according to claim 18, wherein said stabilization device is to uniformize the particle size distribution in the polishing liquid.

20. The apparatus according to claim 18, wherein said stabilization device comprises at least one of a filter for removing coarse particles from the polishing liquid, an ultrasonic generating device for breaking up coarse particles in the polishing liquid by applying ultrasonic energy to the coarse particles, and an adding device for supplying at least one of additives and abrasive particles to the polishing liquid to maintain a volume ratio of additives to abrasive particles in the polishing liquid at a constant value.

21. The apparatus according to claim 17, wherein said polishing liquid circulation line has at least one polishing liquid supply pipe for supplying the polishing liquid to said plurality of polishing units.

22. The apparatus according to claim 17, wherein said sensing device is to measure at least one of particle size distribution in the polishing liquid, the number of coarse particles in the polishing liquid, oxidation-reduction potential of the polishing liquid, and solid material concentration of the polishing liquid.

23. A polishing apparatus comprising:

a plurality of polishing units for polishing a substrate;

at least one polishing liquid supply line to communicate with an external polishing liquid supply unit for supplying a polishing liquid to said plurality of polishing units;

a sensing device for detecting properties of the polishing liquid flowing through said at least one polishing liquid supply line; and a stabilization device for maintaining properties of the polishing liquid flowing through said at least one polishing liquid supply line within an allowable range on the basis of an output signal from said sensing device, wherein said stabilization device is to uniformize the particle size distribution in the polishing liquid.

24. The apparatus according to claim 23, wherein said sensing device is to measure at least one of particle size distribution in the polishing liquid, the number of coarse particles in the polishing liquid, oxidation-reduction potential of the polishing liquid, and solid material concentration of the polishing liquid.

25. The apparatus according to claim 23, wherein said stabilization device is to uniformize the particle size distribution in the polishing liquid.

26. The apparatus according to claim 23, wherein said stabilization device comprises at least one of a filter for removing coarse particles from the polishing liquid, an ultrasonic generating device for breaking up coarse particles in the polishing liquid by applying ultrasonic energy to the coarse particles, and an adding device for supplying at least one of additives and abrasive particles to the polishing liquid to maintain a volume ratio of additives to abrasive particles in the polishing liquid at a constant value.

27. The apparatus according to claim 26, further comprising an external polishing liquid supply unit in fluid communication with said at least one polishing liquid supply line.

* * * * *